United States Patent [19]

Kelly

[11] Patent Number: 4,494,247

[45] Date of Patent: Jan. 22, 1985

[54] KNEE/ELBOW GUARD TREATED TO INCREASE DURABILITY AND A PROCESS FOR PRODUCING SAME

[75] Inventor: Michael J. Kelly, Seattle, Wash.

[73] Assignee: Trace Athletic Corporation, Bellevue, Wash.

[21] Appl. No.: 334,872

[22] Filed: Dec. 28, 1981

[51] Int. Cl.[3] ..... A41D 13/06

[52] U.S. Cl. ..... 2/24; 2/16

[58] Field of Search ..... 2/16, 24

[56] References Cited

U.S. PATENT DOCUMENTS 3,990,440 11/1976 Gaylord ..... 2/24
4,198,708 4/1980 Fugere et al. ..... 2/24
4,292,263 9/1981 Hanrahan et al. ..... 2/24
4,354,280 10/1982 Hayes ..... 2/24

*Primary Examiner*—Doris L. Troutman
*Attorney, Agent, or Firm*—Cole, Jensen & Puntigam

[57] ABSTRACT

A portion of the exterior surface material of a knee-elbow protective guard is covered with a treatment mix comprising 4 parts of a polytetrafluorethylene/resin dispersion, one part of an acrylic polymer resin and 5% of a solution of ammonium sulfate. The treatment mix is then applied to the exterior surface material by a silk screening process, and cured by application of heat so that it bonds to the fibers of the exterior surface material of the guard. The treated portion of the resulting protective guard has a substantially lower coefficient of friction than the exterior surface material of an untreated protective guard.

6 Claims, 3 Drawing Figures

KNEE/ELBOW GUARD TREATED TO INCREASE DURABILITY AND A PROCESS FOR PRODUCING SAME

TECHNICAL FIELD

This invention relates generally to the art of protective equipment for use in athletic activities, and more particularly concerns protective guards for limbs and joints, such as the knee and elbow, which have been treated to improve durability.

BACKGROUND ART

Protective guards for sports activities are becoming increasingly specialized, both with respect to particular sports and for particular areas of the body. Many protective guards are adapted for best use in only one sport. One such protective guard is the conventional knee/elbow guard, which is used in basketball, to protect the knees and elbows of the wearer. The conventional knee guard, however, is not appropriate for other gymnasium sports such as, for instance, volleyball, which usually features much more contact between the player and the gymnasium floor than occurs in basketball. This contact, usually caused by diving attempts to keep the volleyball in play, creates a significant amount of stress on the fabric, and produces such high temperatures that the melting point of the fabric, which typically is nylon, is sometimes exceeded. The fabric in the conventional knee/elbow guard thus typically frays, tears, or otherwise becomes unusable in a short amount of time, and must be replaced.

As far as applicant is aware, prior attempts to solve this problem have concentrated on using more durable materials, such as a heavier fabric perhaps with a roughened exterior surface, and a more durable protective pad, rather than treating existing materials. Applicant is aware of certain technology in a non-related field, dealing with fabric treatment, i.e. U.S. Pat. No. 3,513,842 to Gardner, and U.S. Pat. No. 3,528,417 to Keenen show treatment of fabric to produce an improved dressing for wounds, but to the best of applicant's knowledge, it has not been previously suggested to treat a sporting goods protective article such as a knee/elbow knee guard with a protective material to improve the durability of the article.

It is a general object of the present invention to provide an elbow/knee guard for use in athletic activities which has been treated with a protective material to significantly improve its durability, as well as a process for producing such an article.

It is another object of the present invention that such a product be suitable for use in volleyball and other sports played on a smooth floor, where contact between the article and the floor is common.

It is a further object of the present invention that such a product not be significantly different in weight, use or appearance from conventional products of its general type.

It is yet another object of the present invention that such a process not significantly disrupt conventional manufacturing methods for the article.

It is a still further object of the present invention to produce a protective material which is bondable to fabric and which may be used in a variety of applications.

It is another object of the present invention that such a product be repeatedly washable, without loss of the protective material.

It is an additional object of the present invention that the protective material not interfere with the normal stretch capability of the fabric of the knee/elbow guard to which it is applied.

DISCLOSURE OF INVENTION

Accordingly, the present invention is a protective guard which has enhanced durability. The protective guard includes protective material over a desired portion of the outer surface of an untreated article, either by application of the protective material directly to the exterior surface material of the article, or application to a patch of base material, the patch then being secured to the exterior surface material of the article. The protective material has a substantially lower coefficient of friction than the exterior surface material of the article. This significantly reduces the friction between the articles and a floor surface when the wearer of the article makes a contact with the floor. The invention also includes a method which comprises the steps of making a treatment mix which includes (1) a protective material having a substantially lower coefficient of friction than that of the exterior surface material of the article; (2) applying the treatment mix to a base material which is one of the following (a) the exterior surface material of the article, and (b) a section of material which can be attached to the exterior surface of the article; and (3) curing the treatment mix so that the protective material is securely bonded to the base material.

The invention also includes the treatment mix itself for application to a base material. The treatment mix includes a protective material which has a relatively low coefficient of friction, so as to reduce the friction between the base material to which the treatment mix is applied and another surface. The mix also includes an acrylic polymer resin and a catalyst. The protective material, the polymer and the catalyst are selected so that the interaction between them results in a secure bond between the treatment mix and the base material.

BRIEF DESCRIPTION OF THE DRAWINGS

A more thorough understanding of the invention may be obtained by a study of the following detailed description taken in conjunction with the accompanying drawings in which.

BEST MODE FOR CARRYING OUT THE INVENTION

The present invention concerns a knee/elbow guard which is particularly suitable for use in sports such as volleyball which are played on gymnasium floors and in which there is frequent contact between the user and the floor. The product is capable of withstanding the high stress and high temperatures produced when the wearer of the article contacts a smooth floor surface, such as a gumnasium floor, at high speed or with a significant amount of pressure, such as occurs when a person dives across the floor during volleyball. With conventional guards, the high temperature, up to 300° F.-500° F., generated upon contact are often sufficient to partially melt the nylon fibers of the outer fabric or cover portion of the guard. With such stress, the article must be replaced frequently.

In particular, the present invention is directed toward treating a portion of the fabric cover or an otherwise conventional elbow/knee guard by covering or impregnating the fibers of the cover, over a defined area, with a chemical mixture described in more detail hereinafter. Although the process described in this application can be used on various kinds of protective guards, including hand and arm guards, the foregoing explanation of the invention, including the product and the process, is for the particular knee/elbow guard disclosed in U.S. Pat. No. 4,198,708 to Fugere et al., entitled "Elbow/Knee Guard", issued on Apr. 22, 1980, the contents of which are hereby incorporated by reference. The particular configuration of the article shown in the '708 patent should not, however, be considered a limitation on the present invention.

Figure 1:
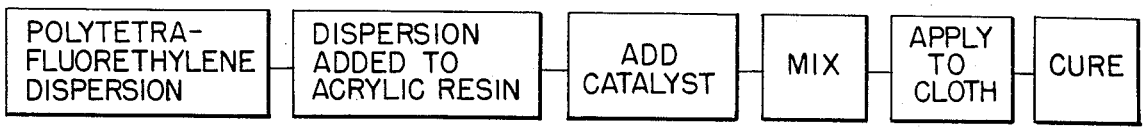
FIG. 1 is a flow diagram for the process of the present invention.

Referring now to FIG. 1, which sets out the steps in the process of the present invention, the protective material in the embodiment shown is polytetrafluorethylene, in resin form, commonly known under the name Teflon, which is a registered trademark of Dupont Corporation. The protective material resin is in the embodiment shown in a dispersion, with a solids ratio of approximately 60% by weight, including a wetting agent of 5.6 to 5.9% by weight. Such a dispersion may be purchased from the Dupont Corporation. However, other fluorocarbon resins may be successfully used as the protective material. The important features of the protective material include a very low coefficient of friction, so that a user wearing a guard with the protective material would tend to slide upon contact the floor, and an ability to withstand relatively high temperatures and stress without deforming or losing its properties.

An acrylic polymer resin is then added to the fluorocarbon dispersion. The polymer resin may include a pigment to color the resulting protective treatment mix, to match or contrast with the color of the guard to which it is to be applied. Otherwise, the treatment mix is clear. In the embodiment shown, the polymer resin used is that available under the trademark HYPLAR from Grumbacher. The Grumbacher product is used because it may be stabilized in ammonium, is compatible with ammonium sulfate, and has a relatively high content of polymer resin relative to any fillers and/or pigment used. The acrylic polymer adds body to the treatment mix, results in more thorough coverage of the portion of the guard to which it is applied, producing a thick face, if desired.

A catalyst is then added to the combination of the fluorocarbon dispersion and acrylic polymer resin to form the treatment mix. Ammonium sulfate is used in the embodiment. The catalyst is necessary to fix the protective material to the fibers of the cloth covering of the knee/elbow guard, so that the treated article can withstand repeated washings without the protective material coming out. To the best of applicant's knowledge, it has not been previously known how to effectively fix such a protective material to the cloth fibers to permit repeated washings. The particular combination of the fluorocarbon dispersion, the acrylic polymer and the ammonium sulfate produces an interaction which results in a bond between the protective material (the fluorocarbon resin) and the cloth covering of the guard strong enough to withstand repeated washings.

In the embodiment shown, a 25% solution of ammonium sulfate is used. The concentration of the ammonium sulfate may be varied to vary the thickness of the resulting treatment mix, i.e., the more water in the ammonium sulfate solution, the more fluid is the treatment mix. The ammonium sulfate solution may also contain a small amount, i.e. 1% in the embodiment shown, of ammonium hydroxide. This tends to keep the ammonium sulfate from separating.

The treatment mix, as described above, comprises 4 parts of the fluorocarbon resin dispersion, one part of an acrylic polymer resin and 5% by volume of ammonium sulfate. Although the above formula may be varied somewhat, the particular ratio described above has proven successful. In mixing the various ingredients, the fluorocarbon dispersion is gradually and evenly added to the acrylic polymer resin at a relatively slow rate so as to avoid coagulation. After the polymer resin has been combined with the fluorocarbon dispersion, the ammonium sulfate is then mixed in to produce the treatment mix. Remixing may be necessary from time to time if a stabilizer such as ammonium hydroxide is not present.

Figure 2:
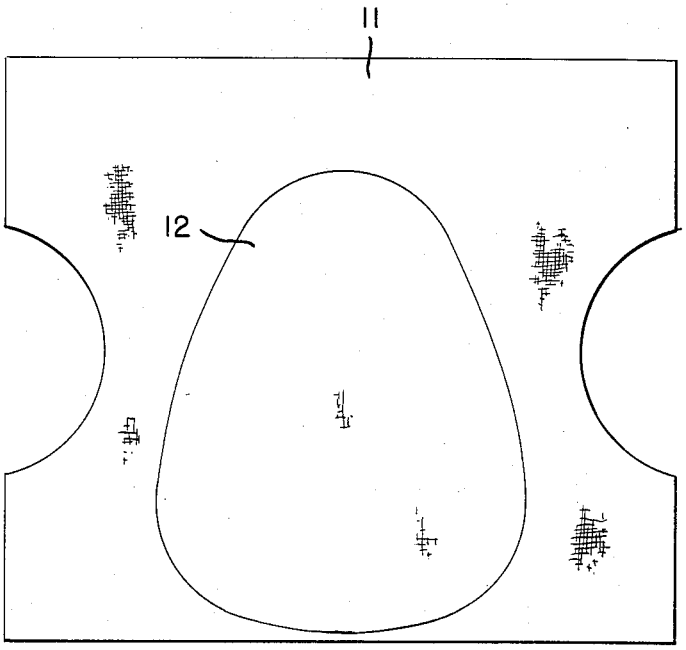
FIG. 2 is a view of the fabric cover portion of a conventional knee/elbow guard showing the configuration of the treated portion.

The treatment mix is then ready to be applied to the cloth covering of the article. Typically, as shown in the '708 patent, protective guards, like knee/elbow guards, comprise an inner protective pad which is capable of absorbing force to some extent, covered by fabric, with elastic straps to hold the article in place on the user. In the process described herein, the above-described treatment mix is applied to the fabric cover 11 of the article (FIG. 2) before the fabric is fitted around the protective pad and the article completed. The treatment mixture may be applied to the cloth before or after it is cut to proper size and may conceivably be applied even after the article is completed. Further, the treatment mix may be applied to a small section of fabric which is then attached to the fabric cover of the article.

The treatment mix may be applied to the cloth in various ways. For instance, the cloth may be dipped into a reservoir of the treatment mix, or the treatment mix may be applied to the cloth by silk screening, by stamping or by pressing, or further, by spraying, brushing or rolling. In any event, the treatment mix must impregnate the cloth over the desired area, covering substantially all of the individual fibers of the cloth in that area. At a minimum, the treatment mix should cover substantially all the surface fibers and their interstices. In the case of the knee/elbow guard, the desired area to be covered is the actual knee area, as well as a small distance to either side and above and below the knee area. The configuration of the pattern of coverage is not particularly critical. In the embodiment shown, the pattern is egg-shaped, such as shown at 12 in FIG. 2. The amount of treatment mix applied must be sufficient to give the desired protection. A thick face of material, for instance, may be achieved by repeated applications of the treatment mix.

After the fibers of the cloth cover have been covered, the treatment mix is cured by heat, which causes the ammonium sulfate catalyst to set the fluorocarbon resin and the acrylic polymer resin. In the embodiment described, this is accomplished at a temperature of approximately 310° F. for two minutes. At the end of this time, the protective material has been securely bonded to the cloth fibers, so that it has the significant advantage of remaining in the fabric during washing.

One preferred method of applying the treatment mix to the cloth is by silkscreening. In such a method, the cloth to be treated, which may or may not be already cut to final dimensions, is laid on the base of a silkscreen frame. The silkscreen, with a desired pattern, is then moved down on top of the cloth. The silkscreen itself, in its frame, may be attached to an automatic, powered lift, so that the movement of the silkscreen is automated.

The treatment mix is then poured over the silkscreen. The treatment mix may include a drying inhibitor, such as that sold under the trademark HYSLO by Grumbacher. Pressure is applied over the pattern area against the cloth by means of a conventional squeegee-like device, or the like, which forces the treatment mix through the pattern onto the cloth. The operation of the squeegee may also be automated. Devices incorporating a powered silkscreen lifter and a squeegee are commercially available. After the treatment mix has been poured and screened, and the cloth coated, the screen is lifted and the cloth removed, at which point the treatment mix in the cloth may be cured, as described above.

The polytetrafluorethylene protective material provides a durable protective coating around the individual fibers and the interstices of the cloth cover of the article. The protective material Teflon has a low coefficient of friction, particularly in relation to the coefficient of friction of the cloth cover, so that there is minimum friction between the article and the floor upon contact. This reduction in friction and also reduction in heat buildup significantly extend the life of the article. With conventional fabric, the friction between the fabric and the floor upon contact results in rapid wear and sometimes even partial melting of the fabric. The advantage of minimum friction, however, is greatest for very smooth floors and is reduced as the floor surface becomes rougher.

Figure 3:
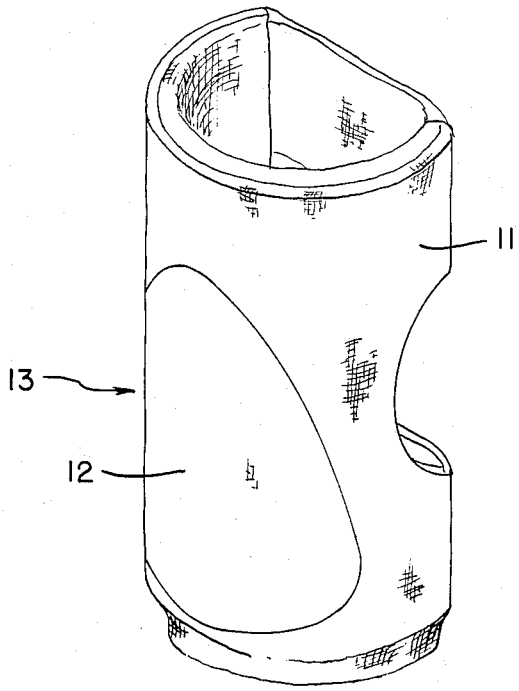
FIG. 3 is an isometric view of the resulting knee/elbow guard treated by the process shown in FIG. 1.

After the treatment mix has been applied and set or cured, the cloth section may continue through the normal manufacturing steps for the article, such as set out in the '708 patent for a knee/elbow guard. FIG. 3 shows the completed treated article at 13 ready for use.

Although the treatment mix is described above as a protective coating for a knee/elbow guard to increase it's durability, it is possible that the same treatment mix may have other applications, particularly with a cloth base, where increased durability or minimum friction surfaces are desirable. Also, it should be understood that various changes, modifications and substitutions may be incorporated in the preferred embodiment described without departing from the spirit of the invention, as defined by the claims which follow.

I claim:

1. A protective article with enhanced durability for use on a human limb, comprising:

a protective guard element which includes an outer fabric section, wherein a selected portion of the fabric section is treated with a protective material in such a manner that a thin film of said protective material is fixed to the selected portion of the fabric section, the protective material having a coefficient of friction which is substantially lower than that of conventional fabrics used for the fabric section, such as nylon.

2. The article of claim 1, including means for bonding the protective material to a base surface material on said protective guard sufficiently to substantially prevent the protective material from separating from the base surface material during washing thereof.

3. The article of claim 2, wherein the base surface material is the exterior surface material of the protective guard.

4. The article of claim 3, wherein the protective material substantially coats the individual fibers and the interstices thereof of said portion of the exterior surface material.

5. The article of claim 4, wherein the protective article is for use on a joint, such as the elbow or knee, and wherein said portion of the exterior surface material which is coated with the protective material is sufficient to cover the joint and the immediate surrounding area.

6. The article of claim 1, wherein the protective material is polytetrafluorethylene, and wherein the bonding means is ammonium sulfate and an acrylic polymer.

* * * * *